United States Patent [19]

Hastie

[11] 4,269,693

[45] May 26, 1981

[54] PROCESS FOR RECOVERING BITUMEN FROM WASTE BITUMINOUS PRODUCTS

[76] Inventor: Anthony M. B. Hastie, Rose Cottage, Hoveringham, Nottinghamshire, United Kingdom

[21] Appl. No.: 41,815

[22] Filed: May 23, 1979

[30] Foreign Application Priority Data

May 30, 1978 [GB] United Kingdom ..... 24168/78

[51] Int. Cl.[3] ..... C10C 1/00; B01D 12/00

[52] U.S. Cl. ..... 208/39; 208/45; 241/23; 241/24; 210/772; 210/776; 210/806

[58] Field of Search ..... 208/39, 45, 179; 210/21, 22 R, 44, 69, 71, 73 R, 83, 173, 174, 772, 776, 806; 209/3, 10, 11, 173; 241/23, 24, 65

[56] References Cited

U.S. PATENT DOCUMENTS

| | | | |
|---|---|---|---|
| Re. 25,467 | 10/1963 | Logan et al. | 208/39 |
| 1,506,115 | 8/1924 | Donaldson et al. | 208/39 |
| 3,061,538 | 10/1962 | Corbett | 208/39 |
| 3,235,483 | 2/1966 | McCoy et al. | 208/39 |
| 3,267,998 | 8/1966 | Simpson | 208/39 |
| 3,451,788 | 6/1969 | Smith | 210/44 |
| 3,794,250 | 2/1974 | Brewer | 241/21 |
| 3,864,251 | 2/1975 | Cymbalisty | 210/44 |
| 3,921,917 | 11/1975 | Meinass | 241/65 |
| 4,008,154 | 2/1977 | Richards et al. | 210/217 |

FOREIGN PATENT DOCUMENTS

| | | | |
|---|---|---|---|
| 993357 | 5/1965 | United Kingdom | 208/39 |

*Primary Examiner*—Charles N. Hart
*Assistant Examiner*—David R. Sadowski
*Attorney, Agent, or Firm*—Poms, Smith, Lande & Rose

[57] ABSTRACT

A process is disclosed for recovering re-usable bitumen from waste bituminous roofing felt and the like. The waste material is cooled, preferably to 0° C. to 5° C., and then comminuted to a particle size less than 5 mm, for example using a flail. The comminuted material is added to water and the material which floats is collected, melted and then filtered to remove particulate or fibrous impurities. Additives may be added to the molten material to adjust its melting point, according to the eventual use of the recovered bitumen. Any fibrous impurities filtered out may be treated with white spirit or kerosene to extract further bitumen, which is then recovered from the solvent.

11 Claims, No Drawings

PROCESS FOR RECOVERING BITUMEN FROM WASTE BITUMINOUS PRODUCTS

This invention relates to a process for recovering bitumen from waste bituminous products, for example, roofing felt.

Large quantities of bitumen are used in such applications as roofing. For example, roofing felt, which is a fibrous mat impregnated with bitumen or a sheet made from bitumen, fibres, and an aggregate, is extensively used, as well as pure bitumen which is melted down and used in surfacing flat roofs. When a roof is resurfaced, the old roofing felt or bitumen is stripped off and discarded, usually because it has become brittle and cracked and therefore pervious to water, and fresh materials are used. Because bitumen is an imported commodity, the cost of fresh materials is high.

The process of the present invention comprises cooling the waste bituminous products to a temperature below the softening point of the bitumen therein, comminuting the cooled products, adding the comminuted products to water and collecting the material which floats on the water, melting the collected material and filtering the melted material to remove particulate or fibrous impurities therefrom.

The filtered material may be further treated to purify the bitumen, and additives may be included to alter the softening temperature of the bitumen to the required level, for example as specified by national or international standards for the purpose for which the bitumen is to be used.

The waste products may be cooled to 0° C. to 10° C., preferably, 0° C. to 5° C., before comminution. The products are suitably comminuted to a particle size of less than 10 mm, preferably less than 5 mm. The waste products may be comminuted using a flail.

The melted material is preferably filtered by passage through a heated sieve, and where fibrous impurities are present these may be treated after filtration with a solvent such as white spirit or paraffin to extract further bitumen, the bitumen then being recovered from the solvent.

The process of the invention is illustrated by the following example.

Waste bituminous roofing felt formed of asbestos and other fibres, and stone chippings, bound together with bitumen, was left in a cold room at a mean temperature of about 4° C. until brittle. The cooled felt was then comminuted to a particle size of less than 5 mm using a chain flail device, and the comminuted particles fed into a tank of water, the stone chippings dropping to the bottom of the tank, together with the dirt, to be removed later. The bitumen and fibres floated at or near the surface of the water and were skimmed from the tank by a bar drawn across it.

The material collected from the surface of the water was dried and then heated to melt the bitumen in it, the melted bitumen being passes through a heated sieve having a mesh size sufficiently small to enable substantially all the fibrous material to be retained thereon, and subsequently removed.

The softening point of the material was adjusted to the level required by mixing in additives of the kind well-known in the preparation of bitumen.

I claim:

1. A process for recovering bitumen from weathered bituminous roofing felt products, said roofing felt products having embrittled and flexible layers with particulate on fibrous impurities therein, which comprises cooling said products to a temperature below the softening point of the bitumen therein, comminuting the cooled products, adding the comminuted products to water and collecting the material which floats on the water, melting the collected material and filtering the melted material to remove particulate or fibrous impurities therefrom and thereby recovering said bitumen.

2. A process according to claim 1, wherein the filtered material is further treated to purify the bitumen.

3. A process according to claim 1, wherein additives are mixed with the filtered material to alter the softening temperature thereof to the required level.

4. A process according to claim 1, wherein the products are cooled to 0° C. to 10° C., before comminution.

5. A process according to claim 1, wherein the products are cooled to 0° C. to 5° C. before comminution.

6. A process according to claim 1, wherein the products are comminuted to a particle size of less than 10 mm.

7. A process according to claim 1, wherein the products are comminuted to a particle size of less than 5 mm.

8. A process according to claim 1, wherein the products are comminuted using a flail.

9. A process according to claim 1, wherein the melted material is filtered by passage through a heated sieve.

10. A process according to claim 1, wherein any fibrous impurities filtered from the melt are treated with a solvent to extract bitumen therefrom, and the bitumen is then recovered from the solvent.

11. A process according to claim 10, wherein the solvent is paraffin or white spirit.

* * * * *